United States Patent [19]

Albrecht et al.

[11] Patent Number: 4,549,492

[45] Date of Patent: Oct. 29, 1985

[54] MATERIAL CLAMP FOR SEWING MACHINES

[75] Inventors: Ernst Albrecht, Hochspeyer; Edgar Busch, Trippstadt, both of Fed. Rep. of Germany

[73] Assignee: Pfaff Industriemaschinen GmbH, Fed. Rep. of Germany

[21] Appl. No.: 613,289

[22] Filed: May 23, 1984

[30] Foreign Application Priority Data

May 28, 1983 [DE] Fed. Rep. of Germany ..... 3319420

[51] Int. Cl.[4] ..... D05B 39/00

[52] U.S. Cl. ..... 112/76; 112/114

[58] Field of Search ..... 112/76, 70, 65, 104, 112/114, 71, 72, 73, 74, 75

[56] References Cited

U.S. PATENT DOCUMENTS 1,823,522 9/1931 Allen ..... 112/76

2,510,014 5/1950 Faulkner ..... 112/76

*Primary Examiner*—Peter Nerbun

*Attorney, Agent, or Firm*—McGlew and Tuttle

[57] ABSTRACT

The cloth clamp comprises a pivot arm provided with a clamp foot, which arm can automatically assume a closed position through a toggle lever drive, a setting lever connected therewith, and an extension spring acting on the setting lever counter to the force of a leaf spring packet acting on the toggle lever drive. An actuating mechanism is needed only for opening the cloth clamp.

7 Claims, 4 Drawing Figures

MATERIAL CLAMP FOR SEWING MACHINES

FIELD AND BACKGROUND OF THE INVENTION

This invention relates in general to sewing machines and in particular to a new and useful material clamp for sewing machines.

A cloth clamp for sewing machines is disclosed in German Pat. No. 809,624*. The cloth clamp has two pivot arms, each carrying a clamp foot. The pivot arms are connected via a pull rod, which carries a compression spring and is provided with a shoulder, and via a pitman with a toggle lever drive for each. By the spring-supported articulation of a toggle lever drive it is intended to achieve a large tensioning range of the pivot arms and to keep the closing force small. On a housing fixed shaft of one of the toggle joint levers a setting lever is fastened, to which is assigned a closing mechanism formed by a driven cam and a lever. A push rod is associated with a second setting lever of the cloth clamp along with an opening mechanism also formed by a driven cam and a lever. After the toggle drives have been pivoted into flexed position as the cloth clamp opens, the pivot arms are raised into an upper position by a thigh spring for each .

*Corresponding to U.S. Pat. No. 2,510,014

Since during the closing of the cloth clamp not only the force of the compression springs connected with the toggle joint drive but also the force of the thigh springs must be overcome, the objective of keeping the closing force small is achieved only incompletely. Another disadvantage is that for the closing and for the opening of the cloth clamp separate mechanisms, to be coupled with the sewing machine at the required moment, are needed.

SUMMARY OF THE INVENTION

The invention provides a cloth clamp which requires a small closing force and only one actuating mechanism for closing as well as for opening the clamp.

As the cloth clamp closes, a spring acting counter to the lowering movement of the pivot arm need not be overcome and the large force required for the flexible tensioning of the pivot arm must be exerted only toward the end of the clamp closing movement, at a time when the toggle joint levers of the toggle lever drive approach the extended position and a small force oriented crosswise to the extended position produces a large spreading force. The closing process can be carried out automatically by a continuously active spring. The moment for the closing of the cloth clamp is determined by the shift state of the actuating mechanism serving to open the cloth clamp. As soon as the actuating mechanism is shifted into the inoperative position, e.g. by a pedal, the cloth clamp is immediately closed by the spring alone, without exertion of an external setting force.

The measure according to which the toggle lever drive is oriented transverse to the movement path of the clamp foot in its extended position makes possible a compact construction of the cloth clamp, in that the toggle lever drive is arranged substantially parallel to the pivot arm. Since in its extended position the toggle lever drive extends substantially crosswise to the movement path of the clamp foot retaining the work, there results further a large tensioning range of the cloth clamp.

An especially simple design of the cloth clamp is that the toggle lever drive is connected directly with the pivot arm without interposed parts.

The use of a leaf spring for the adjustment of the effective length of the toggle joint contributes to a compact construction of the cloth clamp and presents the functional advantage that the force needed for tensioning the pivot arm is obtained already with a slight deflection of the leaf spring. Therefore the predominant part of the lowering movement of the pivot arm can be carried out with the leaf spring not yet tensioned, owing to which the closing process occurs at relatively great speed.

Another advantageous structural realization of the cloth clamp includes the measure of actuating the multi-arm setting lever by a roller lever which by an abutment piece engages at one arm of the setting lever. With this arrangement it becomes possible by appropriate selection of the lever lengths to establish a transmission ratio such that the actuating mechanism can be operated without auxiliary drive, e.g. via a pedal.

Accordingly it is an object of the invention to provide a material clamp for sewing machines which includes a pivoted arm provided with a clamp foot in an arrangement in which the arm automatically assumes a closed position under the influence of a toggle lever drive and a setting mechanism lever connected therewith and an extension spring including a leaf spring packet and which includes an actuating mechanism for opening the clamp.

A further object of the invention is to provide a material clamp for sewing machines which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
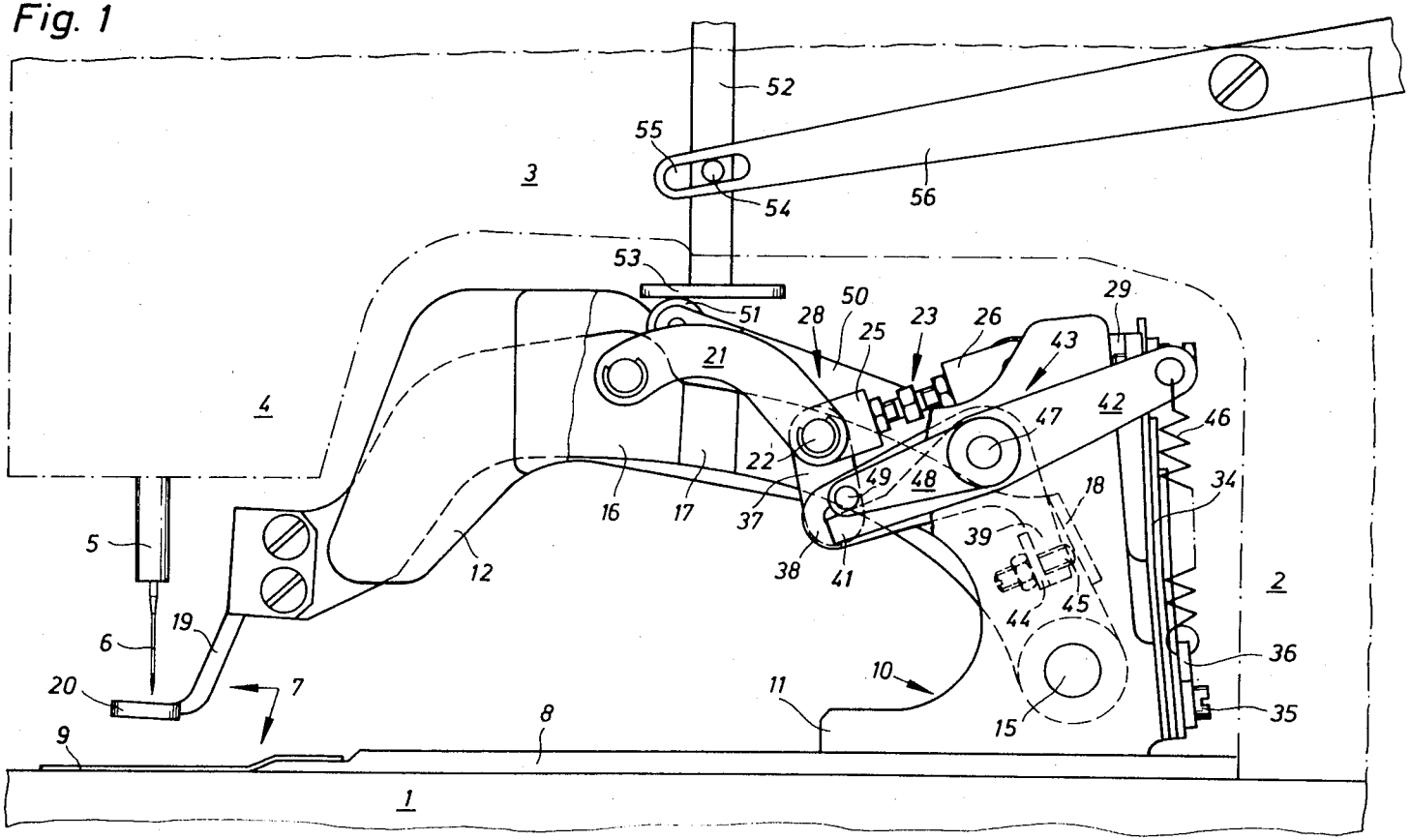
FIG. 1 is an elevational view of a partially shown sewing machine and a cloth clamp, partially in section and shown in the open state.

Referring to the drawings in particular the invention embodied therein comprises a material clamp for sewing machines 1 having a support 9 over which the material is fed. The clamp includes a pivot arm 19 having one end with a material engaging part in the form of a foot 20. A toggle lever drive 28 for the arm is pivotally supported at one end and has an opposite end pivotally connected to the arm 19. Setting means 43 are associated with the toggle lever drive generally designated 28 and acts thereon to adjust the arm during movement between a position in which the clamping foot 20 engages the material to a position in which the arm with the clamping foot is moved away from the material to unclamp the material. A spring mechanism 34 is connected to the toggle lever drive 28 and includes an extension spring 46 and a leaf spring packet 34. The spring mechanism biases the arm in one direction in respect to the clamping and unclamping of the material. Setting means 43 act on the pivot arm to counter the biasing of the spring mechanism. The arrangement includes an actuating mechanism 47 to 51 which is coupled to the setting means 43 and effects the flexing of the toggle lever drive 28.

The housing of the sewing machine comprises a support arm 1, a standard 2, and an arm 3 which terminates in a head 4. Head 4 contains the needle bar 5, moving up and down in known manner, which carries a needle 6.

The cloth clamp 7 comprises a carrier plate 8 resting on the support arm 1 and connected in drive relation with a known feed drive (not shown). At the front end of the carrier plate 8 a cloth support plate 9 is attached. Fastened on the carrier plate 8 is further a frame 10 which consists of a bearing plate 11, two mutually spaced sideplates 12 of a cross strut 13, and a backwall 14.

Figure 2:
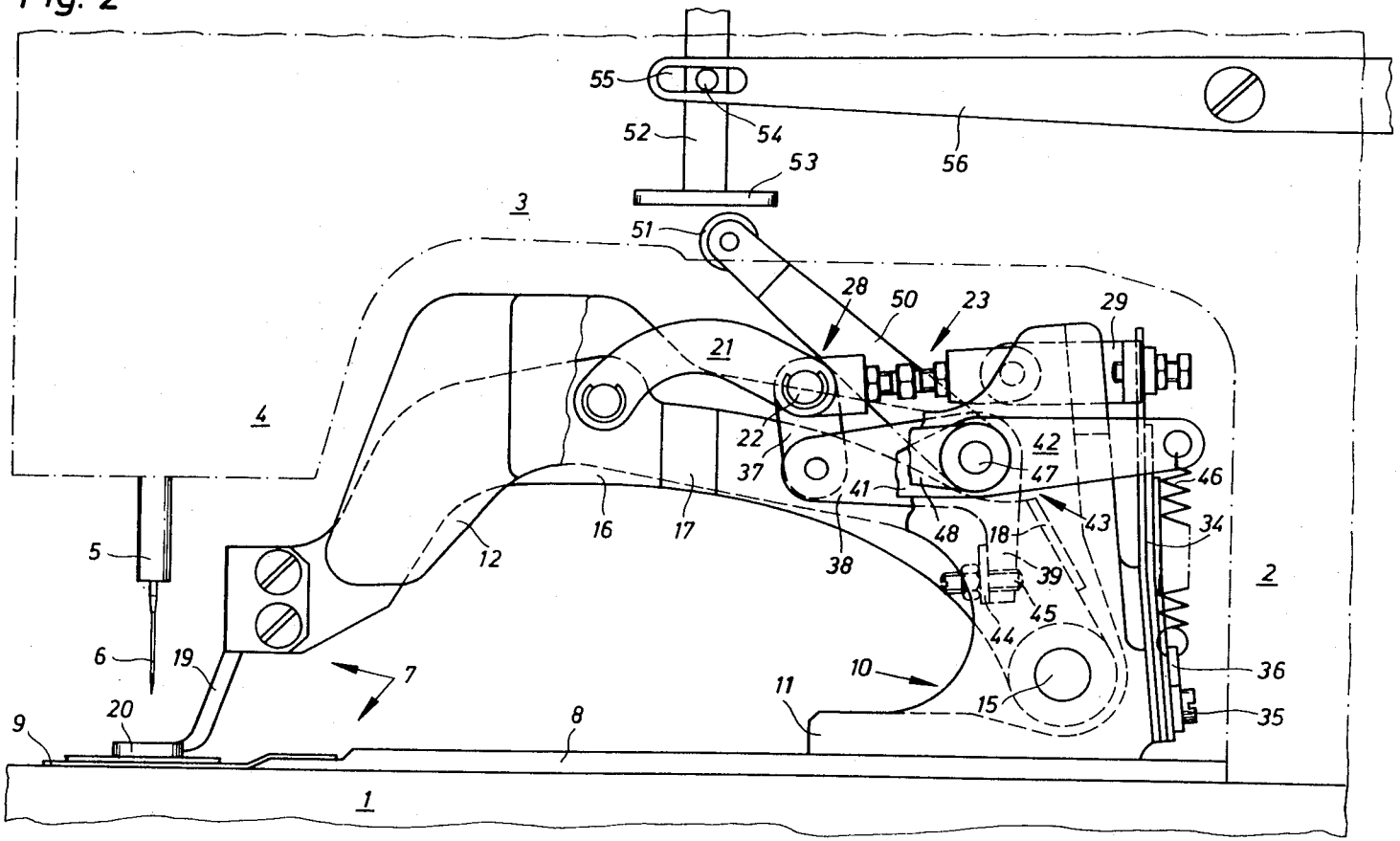
FIG. 2 is a view similar to FIG. 1 of the partially shown sewing machine and of the cloth clamp, partially in section, in the closed state.
Figure 3:
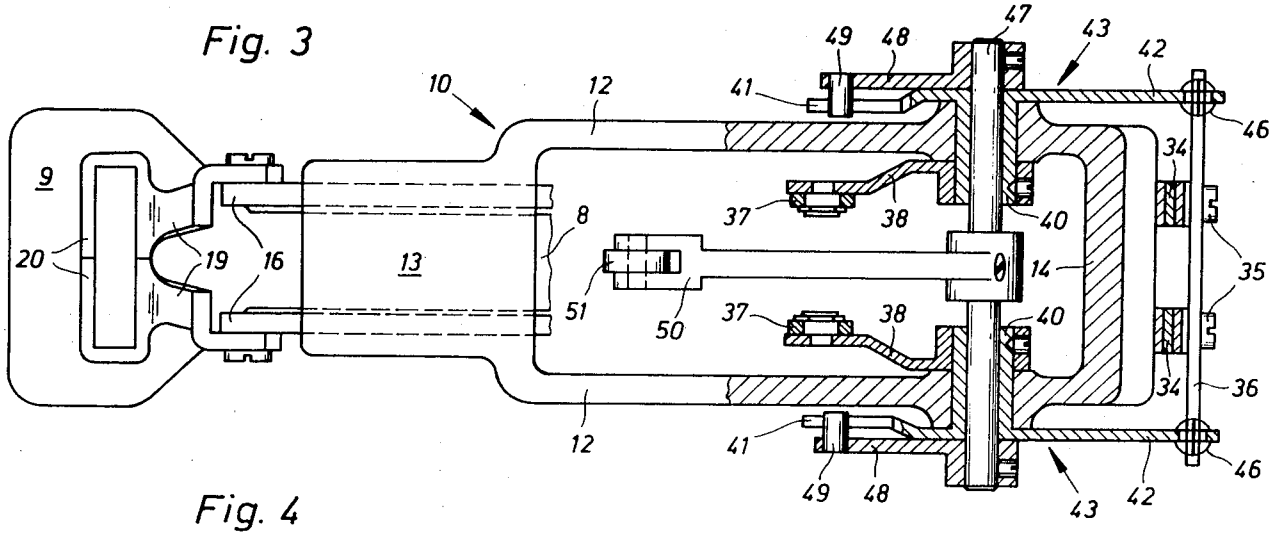
FIG. 3 is a partially sectional plan view of the cloth clamp, omitting the toggle joint levers.

On a stud 15 arranged in the sideplates 12 two pivot arms 16 are mounted so as to be movable independently of each other. Each pivot arm 16 has a bend 17 and carries an abutment plate 18 projecting laterally in the direction of the adjacent sideplate 12 (FIGS. 1,2). At the free end of each of the pivot arms 16, a shank 19 is fastened, at which a U-shaped clamp foot 20 extending horizontally is formed.

Figure 4:
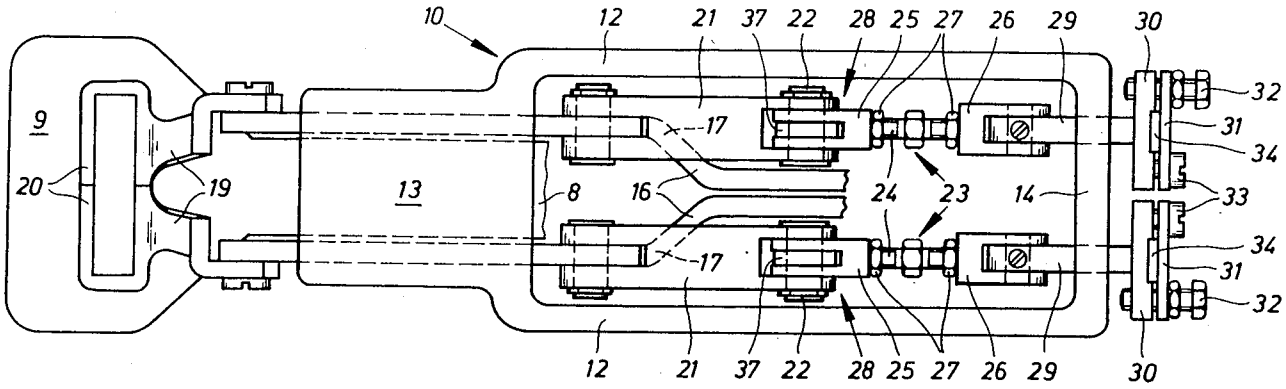
FIG. 4 is a partially sectional plan view of the cloth clamp, omitting the setting levers.

Articulated at each pivot arm 16 is a toggle joint lever 21 fork-shaped at its ends. Each toggle joint lever 21 is connected via a stud 22 with a second toggle joint lever 23, which consists of two fork-shaped endpieces 25,26 joined by a threaded bolt 24 (FIG. 4), and of two nuts 27. The threaded bolt 24 screwed into the endpieces 25,26 has at one end a left-hand and at the other end a right-hand thread. The toggle joint levers 21,23 form for each pivot arm 16 a toggle lever drive 28.

The endpieces 26 are articulated each to a longitudinally displaceable pressure piece 29. The pressure pieces 29 are guided laterally in recesses of the backwall 14 and each comprises outside the frame 10 a transversely projecting shoulder 30. On each shoulder 30, the upper end of a leaf spring packet 34 is fastened through a clamping plate 31 and two screws 32,33. The lower end of the leaf spring packet 34 is fastened by screws 35 and a clamping strip 36 to the backwall 14 in the region of the bearing plate 11. The outer screws 32 serve at the same time as stops taking support on the backwall 14.

On each of the central studs 22 of the two toggle lever drives 28 one end of a pitman 37 is arranged, the other end of which is connected with an arm 38. Each arm 38 is fixed jointly with an additional arm 39 (FIGS. 1,2) on a hub 40 rotatably mounted in the respective sideplate 12. At the end of each hub 40 located outside frame 10, two arms 41, 42 are formed. The arms 38,39,41 and 42 and the hub 40 form a setting lever 43. Each of the two arms 39 is provided with a laterally projecting plate 44 (FIGS. 1,2) to receive an adjustable stop screw 45. The stop screws 45 can come into operative connection with the stop plate 18 of the associated pivot arm 16. At the outer end of each arm 42 is fastened one end of an extension spring 46, the other end of which is arranged at the strip 36.

A shaft 47 is mounted freely rotatable in the two hubs 40. At each of the two ends of shaft 47 an abutment arm 48 is fastened, which carries a transversely projecting pin 49 extending into the pivot path of the associated arm 41. On shaft 47 is fastened further a shift lever 50, which carries at its free end a roller 51. Above roller 51, in arm 3, a vertically extending sliding bar 52 is mounted, which carries a pressure plate 53 cooperating with the roller 51 and a transversely projecting pin 54. Pin 54 extends into a slot 55 of a two-arm lever 56, which is connected via a linkage (not shown) with a pedal also not shown.

DESCRIPTION OF OPERATION

In the open position of the cloth clamp 7 shown in FIG. 1, the sliding bar 52, pushed down through lever 56, holds the shift lever 50 in a downwardly pivoted position. In this position, the abutment arms 48 press via the pins 49 the arms 41 and 38 of the two setting levers 43 also into a lower pivot position, counter to the force of the extension springs 46. In so doing, the arms 38 maintain the two toggle lever drives 28 in the flexed position via the pitmans 37, the leaf spring packets 34 being relieved. Further the abutment screws 45 apply against the associated abutment plates 18 and holds the pivot arms 16 in the raised position shown in FIG. 1.

To close the cloth clamp 7, the pedal connected with lever 56 is relieved. Thereupon the extension springs 46 pivot the two setting levers 43 clockwise according to FIG. 2, whereby the arms 38 move the toggle joint levers 21,23 into their extended position via the pitmans 37. At the same time the shift lever 50 is raised through the arms 41 and made to follow the pressure plate 53 moving upward through a spring mechanism(not shown). At the same time the arms 39 move away from the abutment plates 18. The upward pivoting of the toggle joint levers 21, 23 causes a spreading of the toggle lever drives 28, thereby increasing the distance between the hinge points of the toggle joint levers 21 at the pivoting arms 16 on the one hand and the hinge points of the toggle joint levers 23 at the pressure pieces 29, on the other. During the spreading movement of the toggle lever drives 28, the pressure pieces 29 are at first held in their position by the leaf spring packets 34, so that during this time the increased distance of the hinge points has an effect only at the hinge points of the toggle joint levers 21 at the pivot arms 16. Accordingly, the pivot arms 16 are pivoted downward without any special exertion of force solely through the action of the extension springs 46.

Not until toward the end of the descending movement of the pivot arms 16, the clamp feet 20 pressing onto the work placed on the cloth support plate 9, does a force directed against the further closing movement of the cloth clamp 7 build up. But since at that time the toggle joint levers 21, 23 have already approached their extended position, the extension springs 46 exert via the toggle joint levers 21,23 a more than proportionally increasing closing force, whereby the toggle joint levers 21,23 are pivoted completely into their extended position without the aid of a servo device. Through the threaded bolts 24, the length of the toggle joint levers 23, and via the screws 32, the spring path of the leaf spring packets 34, are adjusted so that in the extended position of the toggle joint levers 21,23, or in the closed position of the cloth clamp 7 the pressure pieces 29 are pushed back by about 2 to 3 mm counter to the force of the leaf spring packets 34 and therefore the work is elastically clamped between the cloth support plate 9 and the clamp feet 20.

Since in the extended position the toggle joint levers 21,23 extend substantially horizontally and hence crosswise to the pivot path of the clamp feet 20, there results a large transmission ratio, i.e. small path or length variations at the toggle lever drives 38 cause comparatively large stroke paths of the clamp feet 20. It follows therefrom that the cloth clamp 7 has a relatively large tensioning range and only extreme deviations of the cloth thickness from a mean cloth thickness range require a corresponding adaptation of the toggle joint levers 23 as to length.

In the closed position of the cloth clamp 7, the toggle joint levers 21,23 are continually held in the extended position by the extension springs 46, so that there is no possibility for the cloth clamp 7 to open by itself. Since each of the two clamp feet 20 has assigned to it its own toggle lever drive 28, with leaf spring packet 34, its own setting lever 43 and its own extension spring 46, the clamp feet 20 can adapt themselves to different cloth thicknesses of the work in the region of stitch formation.

To open the cloth clamp 7, the sliding bar 52 is moved downward by way of the pedal, whereby the pressure plate 53 pivots the shift lever 50 downward. In so doing, the abutment arms 48 pivot the two setting levers 43 counterclockwise into the position shown in FIG. 1, the toggle joint levers 21,23 being moved into a flexed position and the pivot arms 16 being raised. In the course of the pivot movement of the setting levers 43, the abutment screws 45 place themselves against the abutment plates 18 and support the upwardly directed pivot movement of the pivot arms 16.

While a specific embodiment of the invention has been shown and described in detail to illustrate the application of the principles of the invention, it will be understood that the invention may be embodied otherwise without departing from such principles.

What is claimed is:

1. A material clamp for sewing machines having a support over which the material is fed, comprising a pivot arm having one end with a material engaging part, a toggle lever drive for said arm pivotally supported at one end and having an opposite end pivotally connected to said arm, setting means associated with said drive and acting thereon to adjust said arm during movement between a position in which it engages and clamps the material with said material engaging part to a position in which said arm with said material engaging part is moved away from the material to unclamp the material, a spring mechanism connected to said lever drive including a spring acting on said lever drive to bias in a one direction in respect to the clamping and unclamping of the material, said setting means acting on said toggle lever drive in a direction counter to the biasing of said spring mechanism, and an actuating mechanism coupled to said setting means and effecting a movement of said toggle lever drive.

2. A material clamp according to claim 1, wherein said toggle lever drive becomes oriented substantially transverse to the path of movement of said material engaging part of said pivot arm, said material engaging part comprising a clamp foot.

3. A material clamp according to claim 1, wherein said toggle lever drive is articulated at its one end to said pivot arm and is connected with said spring mechanism at its other end.

4. A material clamp according to claim 1, wherein said spring mechanism includes at least one leaf spring wherein the effective length of said toggle lever drive is adjustable.

5. A material clamp according to claim 1, wherein said setting means includes a multi-arm setting lever having a first arm connected with said spring mechanism, said spring mechanism including an extension spring having one end anchored and an opposite end connected to said first arm, said multi-arm setting lever including a second arm, a pitman connecting said second arm to said toggle lever drive, said multi-arm setting lever including a third arm comprising a stop engaging said pivot arm, said multi-arm setting lever including a fourth arm engageable with said stop and an abutment arm, and a shift lever connected to said abutment arm.

6. A material clamp for sewing machines having a support over which the material is fed, comprising a pivot arm having one end with a material engaging part, a toggle lever drive for said arm pivotally supported at one end and having an opposite end pivotally connected to said arm, setting means associated with said drive and acting thereon to adjust said arm during movement between a position in which it engages and clamps the material with said material engaging part to a position in which said arm with said material engaging part is moved away from the material to unclamp the material, a spring mechanism connected to said lever drive including a spring acting on said lever drive to bias in a one direction in respect to the clamping and unclamping of the material, said setting means acting on said toggle lever drive in a direction counter to the biasing of said spring mechanism, said spring acting in a direction for clamping said material and also including a leaf spring stack connected to said setting means operating to stretch said toggle lever drive and connected to one end of said toggle lever drive, and an actuating mechanism coupled to said setting means and affecting a movement of said toggle lever drive.

7. A material clamp according to claim 6, wherein said setting means includes a multi-arm setting lever having a first arm connected with said spring mechanism, said spring mechanism including an extension spring having one end anchored at an opposite end connected to said first arm and also including a leaf spring stack connected to said setting means and said toggle lever drive, said multi-arm setting lever including second arm, a pitman connected to said second arm and to said toggle lever drive, said multi-arm setting lever including a third arm comprising a stop engaging said pivot arm, said multi-arm setting lever including a fourth arm engaging with said stop and an abutment arm, and a shift lever connected to said abutment arm.

* * * * *